US011274528B2

(12) United States Patent
Fermaniuk et al.

(10) Patent No.: US 11,274,528 B2
(45) Date of Patent: Mar. 15, 2022

(54) FLOW CONTROL NOZZLE AND APPARATUS COMPRISING A FLOW CONTROL NOZZLE

(71) Applicant: RGL Reservoir Management Inc., Calgary (CA)

(72) Inventors: Brent D. Fermaniuk, Sherwood Park (CA); Da Zhu, Calgary (CA); Mike Claerhout, Beaumont (CA)

(73) Assignee: RGL Reservoir Management Inc., Calgary (CA)

( * ) Notice: Subject to any disclaimer, the term of this patent is extended or adjusted under 35 U.S.C. 154(b) by 9 days.

(21) Appl. No.: 16/643,441

(22) PCT Filed: Oct. 5, 2017

(86) PCT No.: PCT/CA2017/051195
§ 371 (c)(1),
(2) Date: Feb. 28, 2020

(87) PCT Pub. No.: WO2019/041018
PCT Pub. Date: Mar. 7, 2019

(65) Prior Publication Data

US 2020/0256163 A1 Aug. 13, 2020

Related U.S. Application Data

(60) Provisional application No. 62/552,290, filed on Aug. 30, 2017.

(51) Int. Cl.

| | |
|---|---|
| ***E21B 41/00*** | (2006.01) |
| ***B05B 1/30*** | (2006.01) |
| *E21B 43/12* | (2006.01) |

(52) U.S. Cl.
CPC ..... *E21B 41/0078* (2013.01); *B05B 1/30* (2013.01); *E21B 43/12* (2013.01)

(58) Field of Classification Search
CPC ..... E21B 41/0078; E21B 43/12; E21B 43/08; E21B 34/08; E21B 41/00; B05B 1/30
See application file for complete search history.

(56) References Cited

U.S. PATENT DOCUMENTS

| | | |
|---|---|---|
| 7,419,002 B2 | 9/2008 | Dybevik et al. |
| 9,027,642 B2 | 5/2015 | Sladic et al. |

(Continued)

FOREIGN PATENT DOCUMENTS

| | | |
|---|---|---|
| CA | 2 862 111 A1 | 8/2013 |
| CA | 2 862 161 A1 | 9/2013 |

(Continued)

*Primary Examiner* — Yong-Suk (Philip) Ro
(74) *Attorney, Agent, or Firm* — Dykema Gossett PLLC

(57) ABSTRACT

A flow control nozzle for regulating flow of fluid into a pipe comprises a body having a portion that is adapted to be received within an opening in the pipe, wherein the body includes a channel extending from an inlet to an outlet opening into the pipe. The channel includes a first section extending from the inlet and a second section extending to the outlet, wherein the first and second sections are connected at an elbow and wherein the first section has a constant cross-sectional area and the second section has a diverging cross-sectional area. An apparatus comprising the flow control nozzle and a base pipe and a screen.

26 Claims, 7 Drawing Sheets

(56) References Cited

U.S. PATENT DOCUMENTS

| | | | | |
|---|---|---|---|---|
| 9,518,455 | B2 | 12/2016 | Franklin et al. | |
| 9,631,461 | B2 * | 4/2017 | Lopez | E21B 43/12 |
| 9,638,000 | B2 | 5/2017 | Dyck | |
| 2006/0048942 | A1 * | 3/2006 | Moen | E21B 43/12<br>166/306 |
| 2006/0118296 | A1 * | 6/2006 | Dybevik | E21B 43/12<br>166/242.1 |
| 2012/0006563 | A1 * | 1/2012 | Patel | E21B 43/14<br>166/373 |
| 2018/0030812 | A1 * | 2/2018 | Ning | E21B 43/12 |

FOREIGN PATENT DOCUMENTS

| | | | |
|---|---|---|---|
| CA | 2 887 860 | A1 | 6/2014 |
| CA | 2 934 369 | A1 | 6/2015 |

* cited by examiner

FLOW CONTROL NOZZLE AND APPARATUS COMPRISING A FLOW CONTROL NOZZLE

FIELD OF THE DESCRIPTION

The present description relates to nozzles used for reducing the energy of fluids flowing there-through. In one particular application, the subject nozzles are associated with pipes used in subterranean hydrocarbon wells and the like.

BACKGROUND

Hydrocarbon reservoirs, such as oil and/or gas reservoirs, are found underground and are accessed by wells. Typically, a wellbore is drilled to the reservoir and the hydrocarbon materials are drawn into a pipe situated within the wellbore. The wellbore may be vertical or horizontal or at any angle there-between. In some cases, where the hydrocarbons comprises a highly viscous material, steam is injected into the hydrocarbon formation to facilitate flow of the hydrocarbons into the wellbore.

The pipes used in wellbores typically have apertures, or ports, along their length, which are designed to allow inflow of hydrocarbon materials in the reservoir and/or injection of steam and/or other viscosity reducing agents pumped from the surface into the reservoir. Overlying the apertures are often provided screens, referred commonly as wire screens, which serve to filter the hydrocarbon materials being produced so as to avoid sand and other solid debris in the well from entering the pipe.

In some situations, it is desirable to limit the flow rate of hydrocarbon materials entering into a pipe, referred to as production, in order to avoid unequal flow rates along the length of the pipe or to prevent damage to the pipe or screen apparatus due to the high pressures of some fluids. In such cases, an apparatus, or flow restrictor, may be used with the pipe to impede the flow of fluids flowing into the pipe. An examples of such flow control device is described in U.S. Pat. Nos. 9,518,455 and 9,638,000. Other flow control devices particularly for steam injection are described in U.S. Pat. Nos. 9,027,642 and 7,419,002.

SUMMARY OF THE DESCRIPTION

In one aspect, there is provided a nozzle for regulating the flow of a fluid through a port in a pipe.

In one aspect, there is provided a flow control nozzle adapted to be provided on an outer surface of a pipe, the pipe having at least one aperture extending through the pipe wall, the nozzle being adapted to regulate flow of fluid through the aperture on the pipe, the nozzle comprising:

- a body having first and second surfaces, first and second sides, and front and rear ends;
- the body having a channel for conducting the fluid there-through, wherein the channel provides fluid communication between a first opening provided on the front end and a second opening provided on the second surface the second opening being adapted to be in fluid communication with the aperture;
- the channel having a first section extending from the first opening and a second section extending to the second opening, the first and second sections being connected at an elbow, wherein the longitudinal axis of the first section is angled with respect to the longitudinal axis of the second section;

- the first section of the channel having a first cross-sectional area and the second section of the channel having a second cross-sectional area, wherein the second cross-sectional area is greater than the first cross sectional area.

In another aspect, there is provided an apparatus for controlling flow of fluids to or from a subterranean reservoir, the apparatus comprising:

- a base pipe for communicating the fluids to or from the reservoir, the base pipe having at least one aperture extending through the wall thereof;
- a screen for filtering the fluids, the screen provided on the outer surface of the base pipe, the screen having at least one opening proximal to the aperture;
- at least one collar provided over the base pipe and adapted to secure the screen to the base pipe; and,
- a nozzle comprising:
  - a body having first and second surfaces, first and second sides, and front and rear ends;
  - the body having a channel for conducting the fluid there-through, wherein the channel provides fluid communication between a first opening provided on the front end and a second opening provided on the second surface the second opening being adapted to be in fluid communication with the aperture on the base pipe;
  - the channel having a first section extending from the first opening and a second section extending to the second opening, the first and second sections being connected at an elbow, wherein the longitudinal axis of the first section is angled with respect to the longitudinal axis of the second section;
  - the first section of the channel having a first cross-sectional area and the second section of the channel having a second cross-sectional area, wherein the second cross-sectional area is greater than the first cross sectional area;
- the nozzle being positioned between the at least one opening of the screen and the aperture on the base pipe and wherein the nozzle is positioned beneath the collar.

BRIEF DESCRIPTION OF THE FIGURES

The features of certain embodiments will become more apparent in the following detailed description in which reference is made to the appended figures wherein.

DETAILED DESCRIPTION

As used herein, the terms "nozzle" or "nozzle insert" will be understood to mean a device that controls the flow of a fluid flowing there-through. In one example, the nozzle described herein serves to control the flow of a fluid through a port in a pipe in at least one direction. As described herein, the nozzle may, in one aspect, take the form of an insert that is provided in an opening, or aperture or port, in the pipe. In another aspect, the nozzle may be received within a recess provided on the pipe.

The term "hydrocarbons" refers to hydrocarbon compounds that are found in subterranean reservoirs. Examples of hydrocarbons include oil and gas.

The term "wellbore" refers to a bore drilled into a subterranean formation, such as a formation containing hydrocarbons.

The term "wellbore fluids" refers to hydrocarbons and other materials contained in a reservoir that are capable of entering into a wellbore.

The terms "pipe" or "base pipe" refer to a length of pipe that is provided in a wellbore provided in a reservoir. The pipe is generally provided with ports or slots along its length to allow for flow of fluids there-through. Each of such ports or slots etc. is collectively referred to herein as an "aperture". As would be understood, the base pipe of the apparatus described herein is adapted to be connected to other tubing members that together form a tubing string that is provided in a wellbore.

The term "production" refers to the process of producing wellbore fluids through the production tubing.

The term "screen", "sand screen" or "wire-wrap screen", as used herein, refer to known filtering or screening devices that are used to inhibit or prevent sand or other solid material from the reservoir from flowing into the pipe.

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other feature, integer, step, component or a group thereof as would be apparent to persons having ordinary skill in the relevant art.

In the present description, the terms "top", "bottom", "front" and "rear" will be used. It will be understood that the use of such terms is purely for the purpose of facilitating the description of the embodiments described herein. These terms are not intended to limit the orientation or placement of the described elements or structures.

Figure 1:
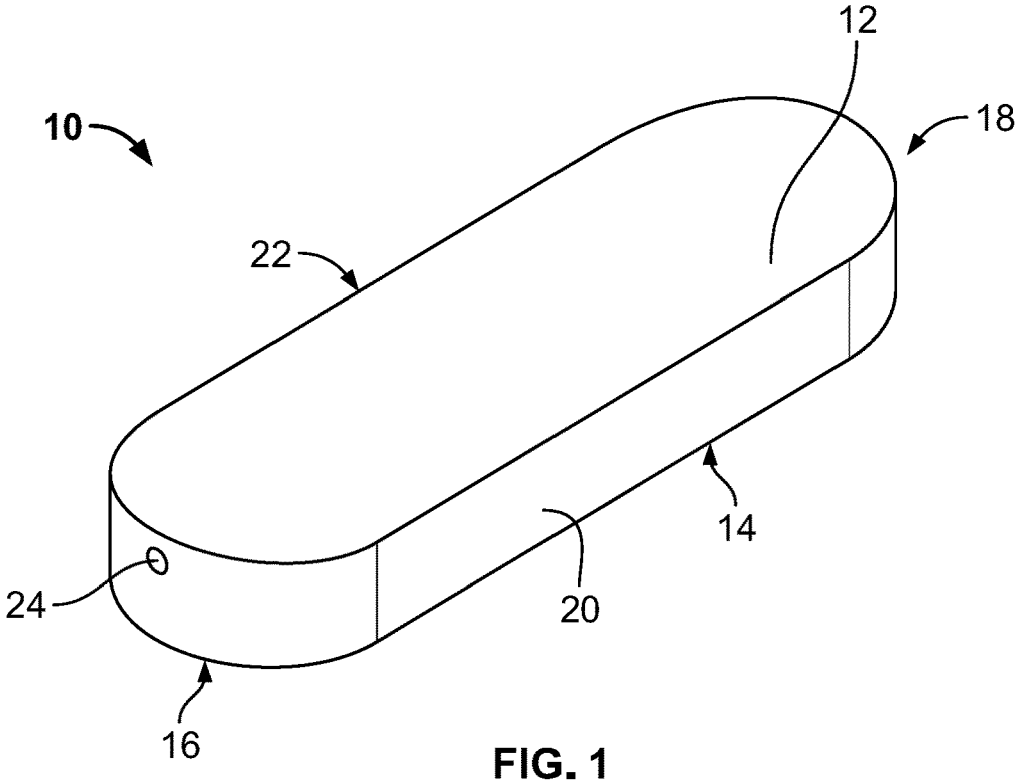
FIG. 1 is a top front perspective view of a nozzle according to one embodiment of the description.
Figure 2:
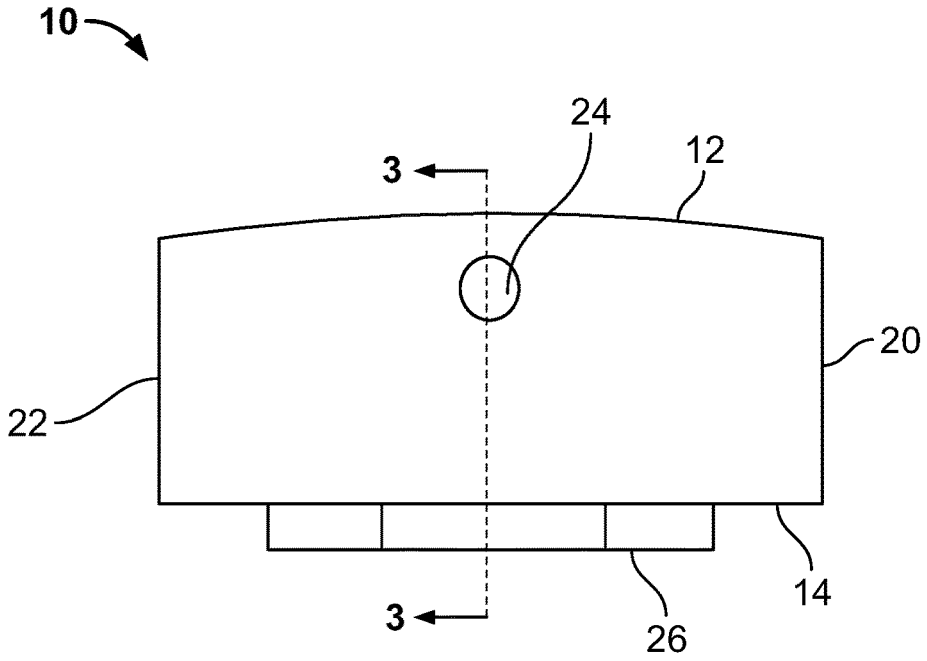
FIG. 2 is a front view of the nozzle of FIG. 1.

FIGS. 1 to 4 illustrate an embodiment of nozzle described herein. As shown, the nozzle 10 comprises a body having a top surface 12, a bottom surface 14, a front end 16, a rear end 18 and sides 20 and 22. The nozzle 10 includes a first opening 24 provided on the front end 16. In one aspect, as illustrated in FIG. 2, the first opening 24 has a generally circular cross section. In other aspects, the first opening 24 may have different cross sectional shapes such as elliptical or oval. In addition, while the first opening 24 is shown as having a squared edge at the front end 16 of the nozzle 10, it will be understood that the first opening may also be bevelled or curved or it may have any other profile.

FIGS. 1 to 4 show the nozzle as having a generally oblong or oval shape; however, it will be understood that the nozzle can be provided with any shape.

Figure 3:
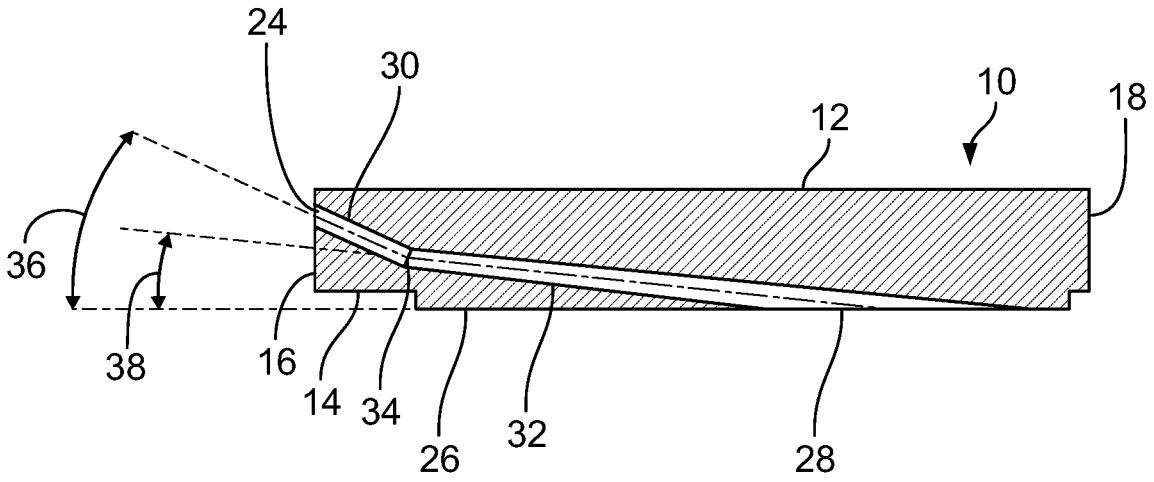
FIG. 3 is a side cross-sectional view of the nozzle of FIG. 1 taken along the line 3-3 of FIG. 2.
Figure 4:
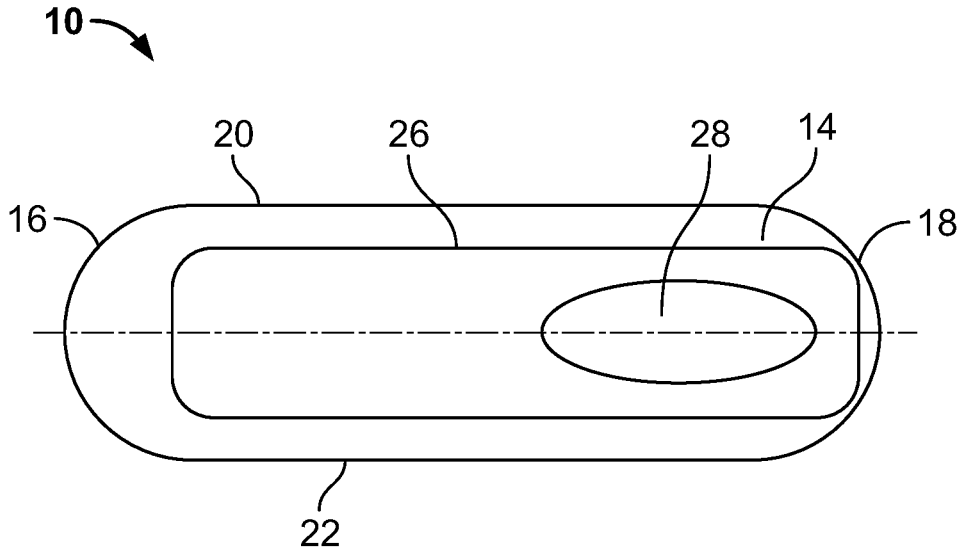
FIG. 4 is a bottom view of the nozzle of FIG. 1.

As shown in FIGS. 2 to 4, the bottom surface 14 of the nozzle is provided with an extension portion 26 having a smaller length and width in relation to the bottom surface 14. As discussed further below, the extension portion 26 is, in one aspect, adapted to be received within an aperture provided in a pipe.

As illustrated in FIGS. 3 and 4, the extension portion 26 is provided with a second opening 28. In one aspect, the second opening 28 has a generally elliptical, oval or oblong cross section as illustrated in FIG. 4. As with the first opening 24, the outer edge of the second opening 28 may be square or provided with any other profile, such as bevelled or curved etc.

As shown in FIG. 3, the first opening 24 and second opening 28 are in fluid communication by means of a channel. The channel includes a first, upstream section 30 connected to and extending from the first opening 24 and a second, downstream section 32 connected to and extending to the second opening 28. The first 30 and second 32 sections of the channel are connected at a transition point or elbow 34. In one aspect, the first section 30 of the channel has a generally constant diameter along its length (i.e. from the first opening 24 to the elbow 34), which is generally the same diameter as that of the first opening 24. In another aspect, the first opening 24 may have a diameter that is different from the diameter of the first section 30 of the channel. For example, the first opening 24 may have a larger diameter than the first section 30.

The second section 32 of the channel is provided with a gradually diverging cross-section extending in a downstream direction, that is a direction from the elbow 34 towards the second opening 28. In one aspect, the second section 32 of the channel is provided with a generally elliptical cross section along its length, thereby terminating in an second opening 28 having the shape shown in FIG. 4. In other aspects, the second section 32 may have a generally circular cross section, whereby the second section 32 is provided with a generally conical shape. As will be understood by persons skilled in the art, the diverging structure of the second section 32 of the channel results in decreasing velocity and increasing pressure of the fluid flowing there-through.

As shown in FIG. 3, the longitudinal axis of the first section 30 of the channel is provided at an angle 36 with respect to the plane of the bottom surface 14 of the nozzle 10. Similarly, the longitudinal axis of the second section 32 of the channel is provided at an angle 38 with respect to the plane of the surface 14 of the nozzle 10. As also shown in FIG. 3, the angle 36 is greater than the angle 38. As will be understood, the elbow 34 forms a transition point in the channel corresponding change in the direction of the longitudinal axes of the first section 30 and second section 32. As will also be understood, and as discussed herein, the elbow forces a change in the flow direction of the fluid and thereby serves to dissipate at least a portion of the energy of the fluid.

Figure 5:
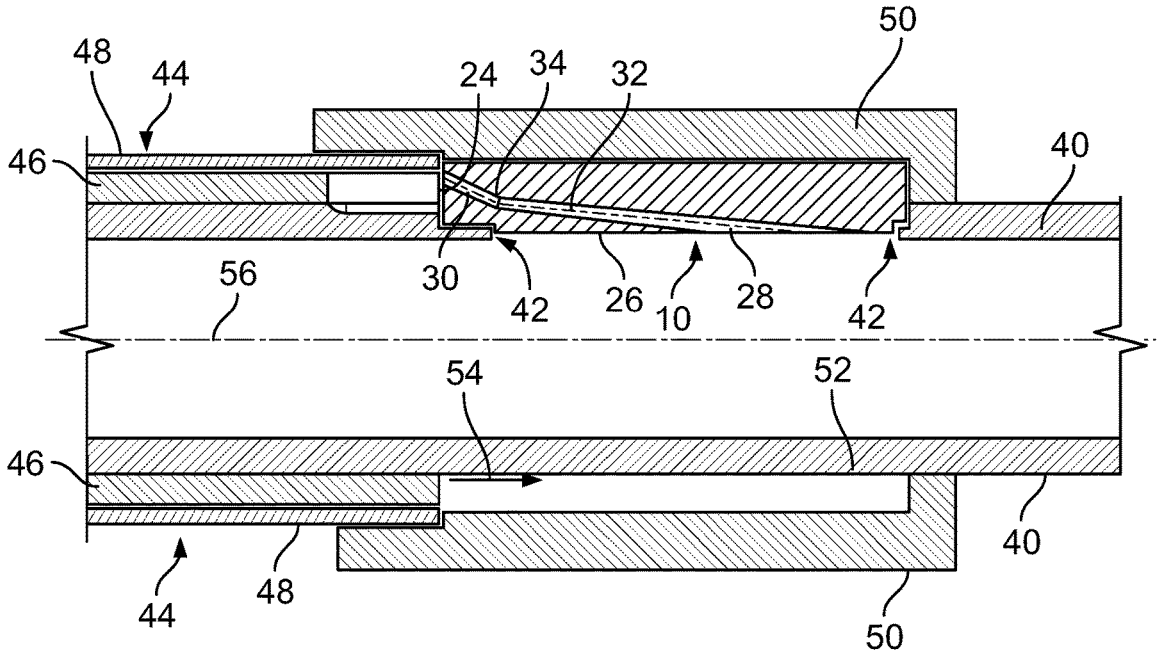
FIG. 5 is a side cross-sectional view of the nozzle of FIG. 1 installed on a pipe.

FIG. 5 illustrates an aspect of the nozzle described above when in use, that is when installed on a base pipe of a flow control apparatus. As shown in FIG. 5, a pipe 40 is provided with an opening or aperture 42 that is adapted to receive the extension portion 26 of the nozzle 10. As would be understood, the base pipe 40 would be adapted to be connected to adjacent tubular members of a tubing string that is inserted into a wellbore. As is known in the art, the tubular members are connected with cooperatively threaded ends. The aperture 42 provides an opening for allowing fluids to flow into or out of the pipe 40. As known in the art, a pipe 40 for use in oil and gas production would typically have a plurality of apertures 42 along its length, where such apertures may be grouped together or evenly distributed. The aperture 42 may be sized so as to snugly receive the extension portion 26 is engaged in a friction- or press-fit manner. Although the above description refers to the aperture 42 being adapted to engage the extension portion 26 of the nozzle, it will be understood that the extension portion 26 may alternatively be formed so as to fit within a pre-existing aperture 42 on the pipe 40. In another alternative, the nozzle may be welded to the pipe 40 with the extension portion 26 engaged within the aperture 42. It will be understood that the present description is not limited to any particular means of retaining the nozzle 10 in combination with the pipe 40.

In one particular aspect, the nozzle 10 is suited to regulate fluids that enter the aperture 42 on the pipe 40 after passing through a filtering device such as a wire-wrap screen 44 as shown in FIG. 5. As commonly known, a wire-wrap screen 44 generally includes a plurality of support ribs 46 provided over the outer surface of the pipe 40, over which is provided a screen material 48. In one known screen, the screen material comprises a series of wire windings provided over the support ribs 46, resulting in a wire-wrap screen 44 as illustrated. As known in the art, a wire-wrap screen 44 is typically secured to a pipe 40 by means of collar 50 or other such device. The collar 50 is provided over wire-wrap screen 44 and secured to the pipe 40 wall by welding or other such means.

Although in the present description, reference is made to a wire-wrap screen, it will be understood that the present description is not limited to such screen. In particular, the nozzle 10 described herein may be used with numerous other filtering devices, such as slotted liners and the like. The present description is not in any way limited to any particular screen device.

As shown in FIG. 5, such collar 50 also serves to retain the nozzle 10 in position over the aperture 42. The collar 50, once positioned over the pipe 40 forms a generally annular space 52, which is in fluid communication with the aperture 42.

As discussed above, the first section 30 and second section 32 of the channel are provided with different angular orientations, 36 and 38, respectively, with respect to the plane of the bottom surface of the nozzle. As illustrated in FIG. 5, the bottom surface of the nozzle 10 is generally parallel with the longitudinal axis 56 of the pipe 40. Therefore, as would be understood, the angular orientations 36 and 38 of the first and second sections, 30 and 32, of the channel would correspond to the angular orientations of the sections with respect to the axis of the pipe 40, when the nozzle is in use. In one aspect, the angle 36 is in the range of about 0° to about 25° and the angle 38 is in the range of about 3° to about 12°. In one aspect, as illustrated in FIG. 3, the angle 36 is about 25° and the angle 38 is about 6°. It will be understood that these ranges of angles will also apply to other aspects of the nozzle described herein. It will also be understood that other angles and ranges of angles may be used.

In operation, and according to one aspect where fluids from a reservoir are being received within the pipe 40, reservoir fluids (including hydrocarbons etc.) contained in a reservoir pass through the wire-wrap screen 44 (or other filtering means) and enter into the annular space 52. The flow of the fluids exiting the screen 44 are shown by arrow 54. The fluids then enter the first opening 24 of the nozzle 10 and are first passed into the generally cylindrical first section 30 of the channel. The fluids then pass through the elbow 34 and into the second section 32 of the channel. Due to the diverging shape of the second section 32 of the channel, the velocity of the fluid, and thereby it's energy, is reduced as it passes through to the second opening 28 and ultimately into the pipe 40.

As will be understood, the elbow 34 described above forces a change in the direction of the fluid travelling through the channel of the nozzle. It will be understood that such change in direction serves to provide an initial dissipation of the fluid's energy prior to entering into the second section 32 of the channel. As discussed above, the diverging shape of the second section 32 of the channel further causes a dissipation of the energy of the fluid. Thus, the combination of the elbow 34 and the diverging second section 32 of the nozzle 10 result in an effective means of regulating flow of fluids from a reservoir into the pipe 40.

As mentioned above, a base pipe 40, such as that shown in FIG. 5, of the apparatus described herein would typically be provided with a plurality of apertures. In such cases, any number of the present flow control nozzles may be provided on such pipe 40 at any desired location. For example, if it is known that a particular section of the pipe will require flow control whereas other sections would not, the nozzles described herein may be provided at only the locations along the pipe where control of fluid flow into the pipe 40 is necessary.

Figure 7:
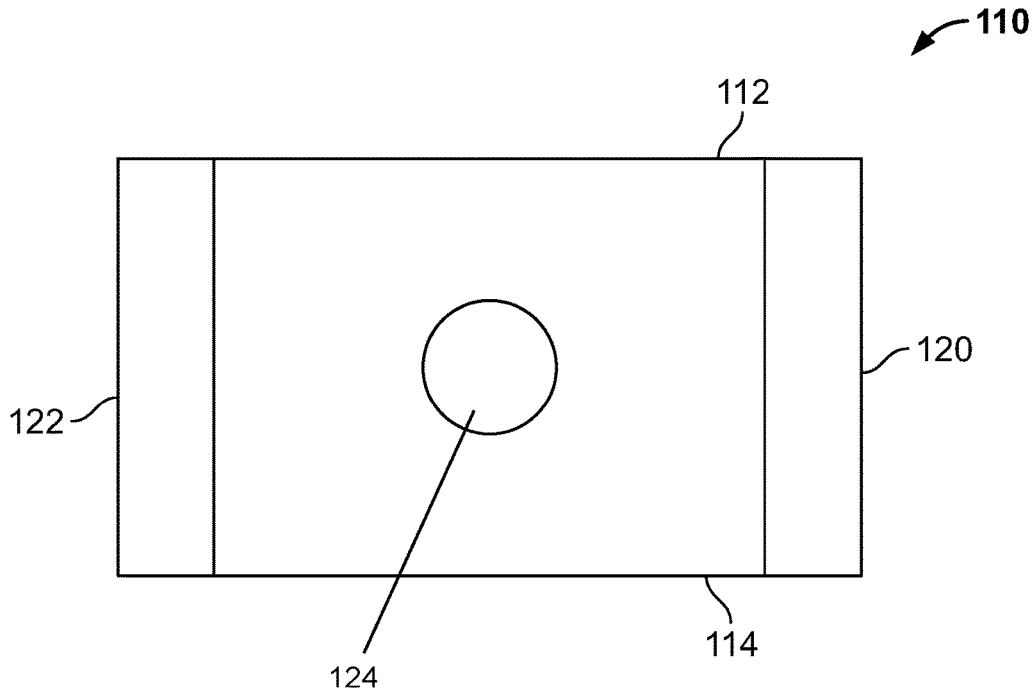
FIG. 7 is a front view of the nozzle of FIG. 6.

Figured 6 to 8 illustrate another embodiment of a nozzle of the present description where elements of the nozzle that are similar to those described above are identified with the same reference numeral but with the prefix "1" added for clarity. As shown, the nozzle according to this embodiment is identified at 110 and comprises a body having a top surface 112, a bottom surface 114, a front end 116, a rear end 118 and sides 120 and 122. The nozzle 110 includes a first opening 124 provided on the front end 116. In one aspect, as illustrated in FIG. 7, the first opening 124 has a generally circular cross section. As discussed above, the first opening 124 may have different cross sectional shapes and may have a squared edge at the front end 116 or one that is bevelled or curved.

It is noted that unlike the previously described embodiment, the nozzle 110 does not include an extension portion. Instead, as illustrated, the bottom surface 114 of the nozzle 110 includes a second opening 128.

Figure 6:
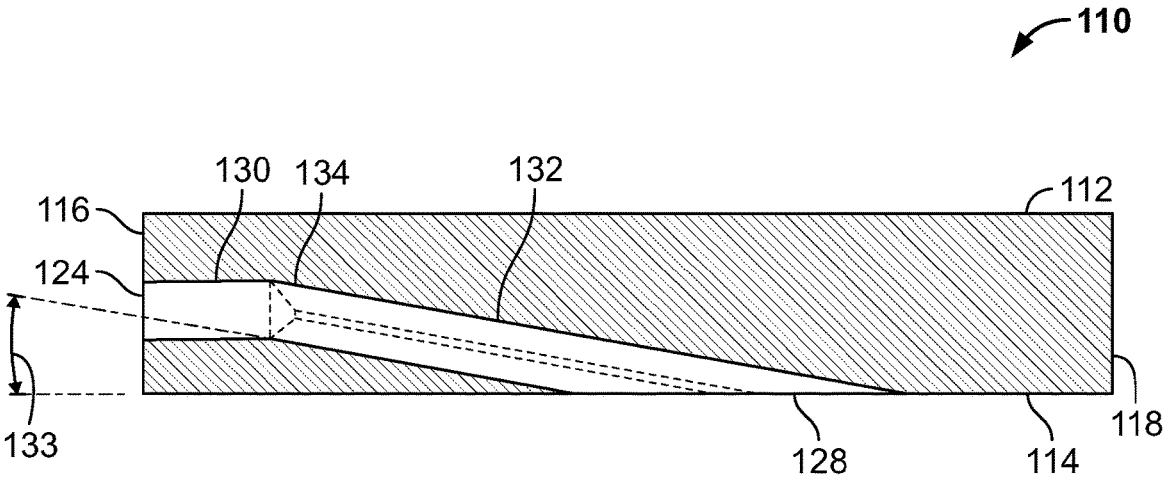
FIG. 6 is a side cross-sectional view of a nozzle according to another embodiment of the present description.
Figure 8:
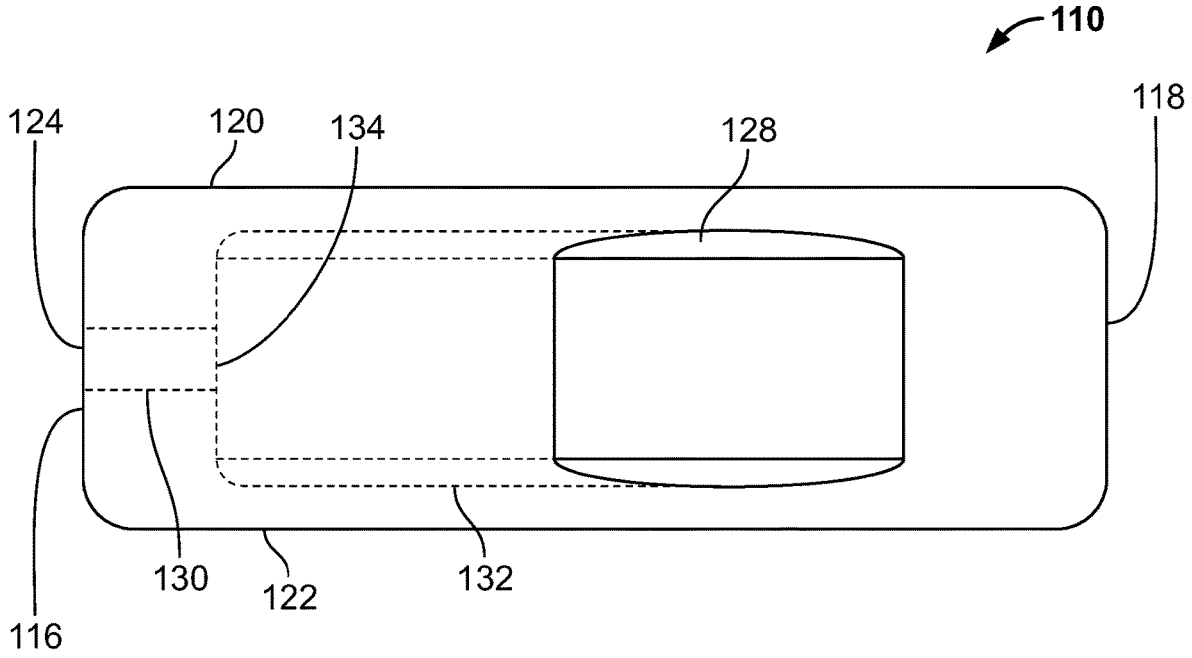
FIG. 8 is a bottom view of the nozzle of FIG. 6.

As shown in FIGS. 6 and 8, the first opening 124 and second opening 128 of the nozzle 110 are in fluid communication by means of a channel. The channel includes a first, upstream section 130 connected to and extending from the first opening 124 and a second, downstream section 132 connected to and extending towards the second opening 128. The first 130 and second 132 sections of the channel are connected at a transition point or elbow 134. In one aspect, the first section 130 of the channel has a generally constant diameter along its length (i.e. from the first opening 124 to the elbow 134), which is generally the same diameter as that of the first opening 124. In another aspect, the first opening 124 may have a diameter that is different from the diameter of the first section 130 of the channel. As also illustrated in FIG. 6, the first section 130 of the channel may be generally parallel with the longitudinal axis of the nozzle 110. As will be described later, in this arrangement, the first section 130 is also generally parallel with the longitudinal axis of the pipe onto which the nozzle 110 is installed. It will be understood that the orientation of the first section of the channel can be varied between the various figures shown herein. Thus, the first section of FIG. 6 may be angled as with the previously described figures and vice versa.

The second section 132 of the channel comprises a widened section of the channel as compared to the first section 130. As shown in FIG. 6, the second section 132 is provided at an angle 133 with respect to the plane of the bottom surface 114, and therefore with respect to the first section 130, whereby the second section 132 is directed from the elbow 134 in a direction towards the bottom surface 114 of the nozzle 110. The angle 133 may be any value such as from about 3° to about 12°. In one aspect, the angle 133 of the second section 132 may be from about 8° to about 10°. It will be understood that these ranges of angles of the second section will also apply to other aspects of the nozzle described herein.

As shown, the second section 132 comprises an expansion zone for fluid entering into the second section 132 from the first section 130. As will be understood, such expansion serves to reduce the energy of the fluid entering the second section 132. In the embodiment illustrated, the second section 132 of the channel of the nozzle 110 comprises a chamber having a generally rectangular cross section that extends from the elbow 134 to the second opening 128. In one aspect, the walls of the second section 132 are generally parallel, whereby the cross-sectional area of the second section 132 is constant along its length. In other embodiments, it will be understood that the second section 132 may comprise other geometries. For example, either of the walls of the second section 132 may diverge from an opposite wall, thereby resulting in the second section 132 having an increasing cross sectional area in the direction from the elbow 134 to the second opening 128. In one aspect, the second section 132 may be provided with rounded internal walls to avoid sharp corners and thereby reduce eddy formation within the second section 132. This is illustrated, for example, in FIG. 8, wherein the channel is depicted with broken lines. As shown in FIGS. 6 and 8, the second opening 128 is formed by the generally rectangular second section 132 of the channel intersecting the bottom surface 114 of the nozzle. Therefore, as shown in FIG. 8, the second opening 128 has a greater surface area as compared to the first opening 124.

Figure 9:
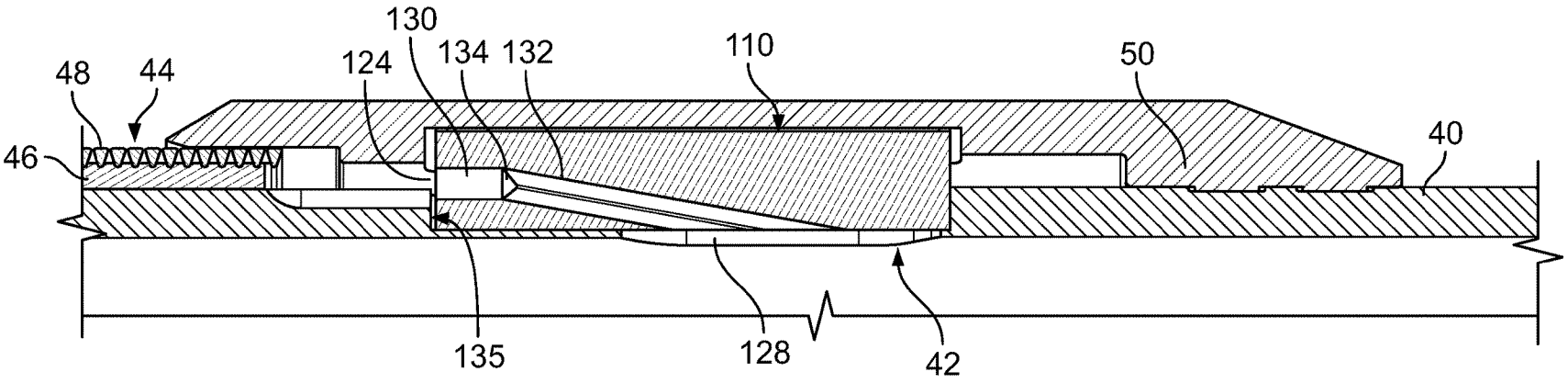
FIG. 9 is a side cross-sectional view of the nozzle of FIG. 6 installed on a pipe.
Figure 10:
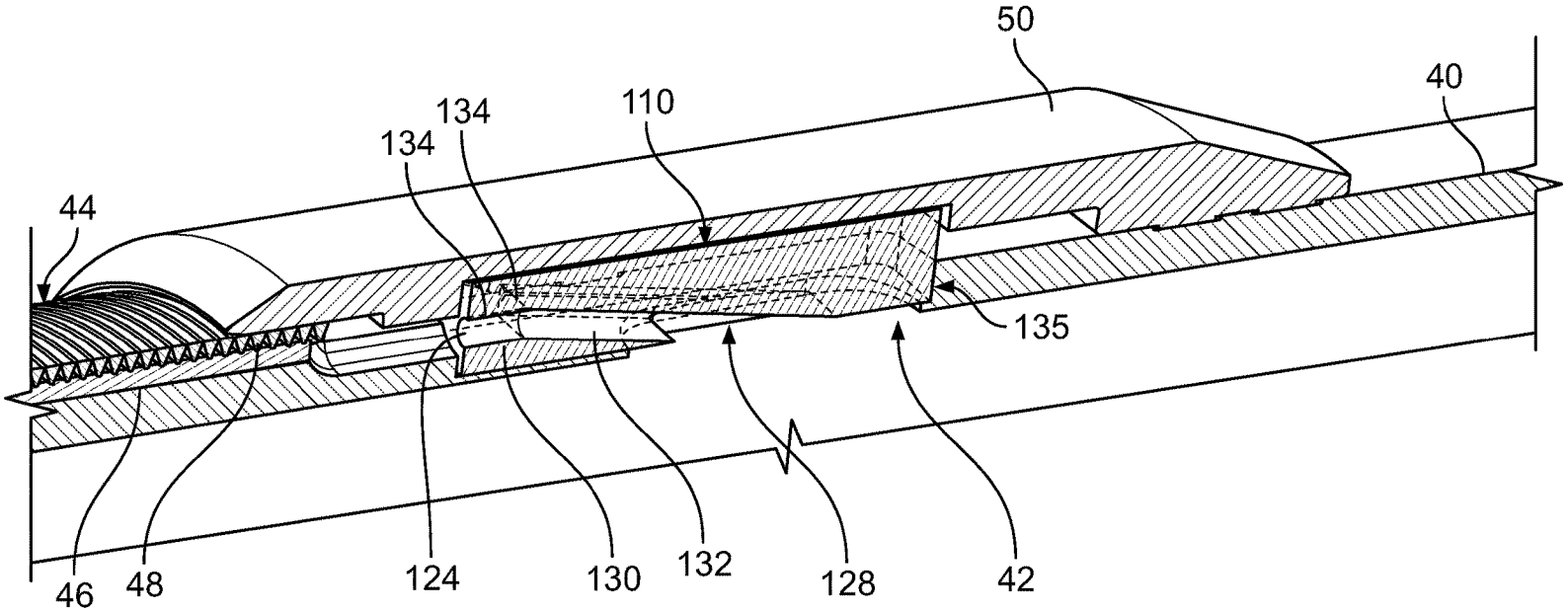
FIG. 10 is a perspective side cross-sectional view of the nozzle of FIG. 6 installed on a pipe.

FIGS. 9 and 10 illustrate a flow control apparatus wherein the nozzle 110 is installed on a base pipe 40. As shown, for this purpose, the pipe 40 is provided with a recess 135 that is sized to accommodate the bottom surface 114 of the nozzle. The recess 135 is provided at the location of an aperture 42 on the pipe. Such apertures were described above. As shown in FIGS. 9 and 10, the recess 135 is sized and positioned so as to allow the second opening 128 to open into the aperture 42. It will also be noted that recess 135 has a depth that is sufficient to receive the nozzle 110 but is not deep enough to block the first opening 124 when the nozzle 110 is installed on the pipe 40.

In an operation where reservoir fluids are to being received within the pipe 40, fluid from the reservoir that passes through the wire-screen filter 44 enters the nozzle 110 through the first opening 124, passes through the first section 130 of channel and is expanded within the second section 132 of the channel. As mentioned above, at this point the energy of the fluid is dissipated. The fluid then passes through the second opening 128 and into the aperture 42, where it finally enters the interior of the pipe 40.

Figure 11:
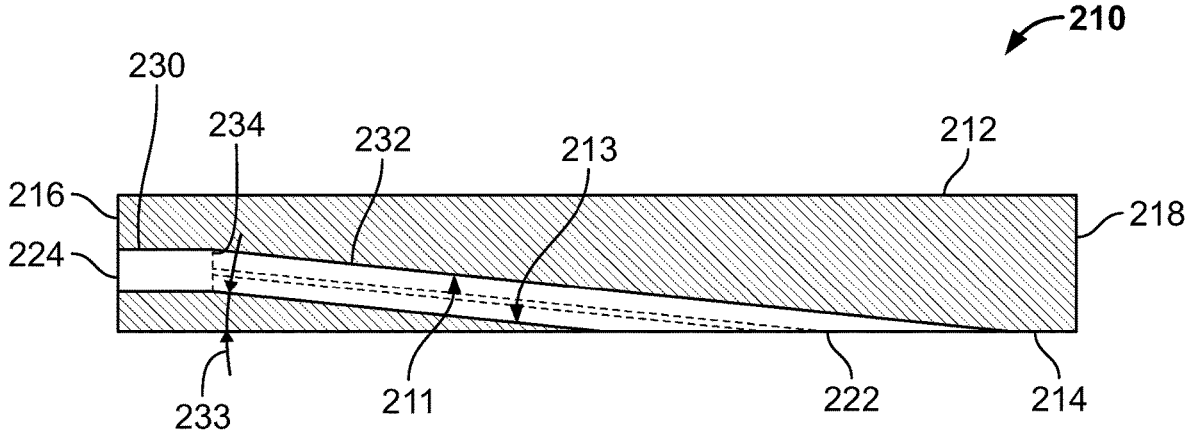
FIG. 11 is a side cross-sectional view of a nozzle according to another embodiment of the present description.
Figure 12:
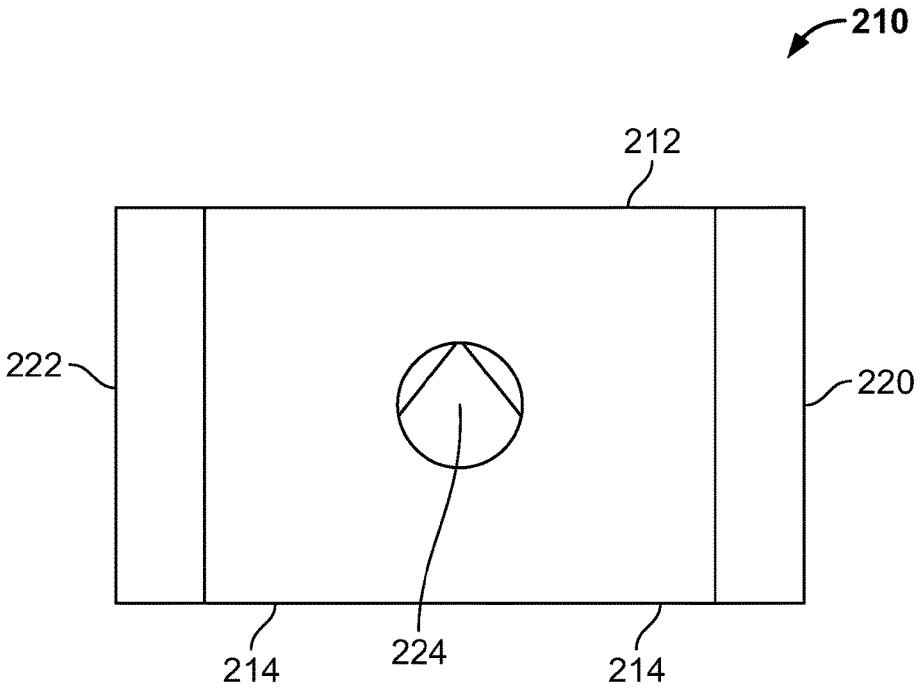
FIG. 12 is a front view of the nozzle of FIG. 11.
Figure 13:
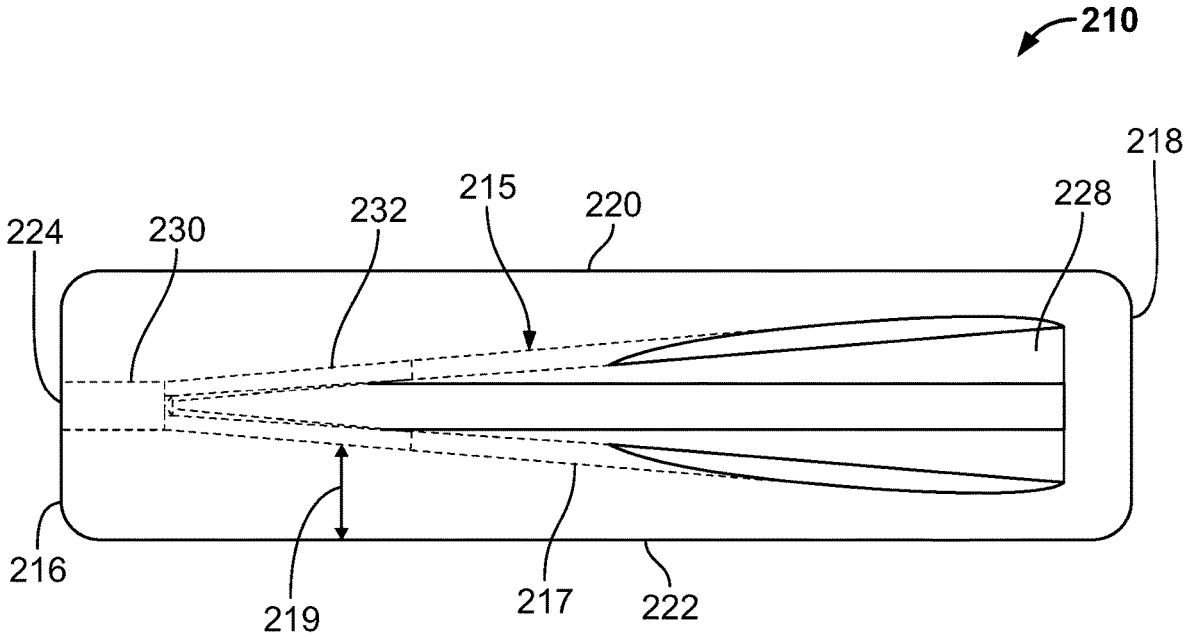
FIG. 13 is a bottom view of the nozzle of FIG. 11.

Figured 11 to 13 illustrate another embodiment of a nozzle of the present description, which is similar to that shown in FIGS. 6 to 10. In FIGS. 11 to 13, elements of the nozzle that are similar to those described above are identified with the same reference numeral but with the prefix "2" added for clarity. As shown, the nozzle according to this embodiment is identified at 210 and comprises a body having a top surface 212, a bottom surface 214, a front end 216, a rear end 218 and sides 220 and 222. The nozzle 210 includes a first opening 224 provided on the front end 216. As noted, the first opening is similar to the first opening 124 of the previously described nozzle 110. As discussed above, although the first opening 224 is shown with a generally circular cross section, other cross sectional shapes may be provided. The bottom surface 214 of the nozzle 210 includes an opening or an second opening 228.

As shown in FIGS. 11 and 13, the first opening 224 and second opening 228 of the nozzle 210 are in fluid communication by means of a channel. The channel includes a first, upstream section 230 connected to and extending from the first opening 224 and a second, downstream section 232 connected to and extending towards the second opening 228. The first 230 and second 232 sections of the channel are connected at a transition point or elbow 234. In one aspect, the first section 230 of the channel has a generally constant diameter along its length (i.e. from the first opening 224 to the elbow 234), which is generally the same diameter as that of the first opening 224. As shown in FIG. 11, the first section 230 of the first opening is generally parallel with the longitudinal axis of the nozzle 210. Thus, the first section 230 of the channel is similar to that of the previously described nozzle 110. The second section 232 of the nozzle 210 is provided at angle 233 with respect to the longitudinal axis of the nozzle 210 and therefore the first section 230. The angle 233 may range from about 3° to about 12°. In one aspect, the angle 233 of the second section 232 may be about 6°.

As also illustrated in FIGS. 11 and 13, the nozzle 210 differs from that described above in that the second section 232 of the channel has a generally flared shape extending from the elbow 234 to the second opening 228. That is, as shown in FIGS. 11 and 13, while the top and bottom walls, 211 and 213, of the second section 232 are, in one aspect, generally parallel, as with the nozzle 110 described above, the side walls, 215 and 217, of the second section 232 diverge from each other along the length of the second section 232. In the result, the second section 232 is provided with a gradually increasing cross-sectional area along its length. In the illustrated embodiment, the side walls 215 and 217 are provided at an angle 219 with respect to the longitudinal axis of the nozzle 210. The angle 219 may be any value and, as would be understood, it would depend on the dimensions of the nozzle 210, the length and width of the first section 230 and desired dimensions of the second opening 228. In one example, the angle 219 may be about 5°. It will be understood that, as with the previously described nozzle, the second section 232 of the channel serves as an expansion chamber to reduce or dissipate at least part of the energy of the fluid entering from the first section 230.

Although the above description includes reference to certain specific embodiments, various modifications thereof will be apparent to those skilled in the art. Any examples provided herein are included solely for the purpose of illustration and are not intended to be limiting in any way. Any drawings provided herein are solely for the purpose of illustrating various aspects of the description and are not intended to be drawn to scale or to be limiting in any way. The scope of the claims appended hereto should not be limited by the preferred embodiments set forth in the above description, but should be given the broadest interpretation consistent with the present specification as a whole. The disclosures of all prior art recited herein are incorporated herein by reference in their entirety.

We claim:

1. A flow control nozzle adapted to be provided on an outer surface of a pipe, the pipe having at least one aperture extending through the pipe wall, the nozzle being adapted to regulate flow of fluid through the aperture on the pipe, the nozzle comprising:

a body having first and second surfaces, first and second sides, and front and rear ends;

the body having a channel for conducting the fluid there-through, wherein the channel provides fluid communication between a first opening provided on the front end and a second opening provided on the second surface the second opening being adapted to be in fluid communication with the aperture;

the channel having a first section extending from the first opening and a second section extending to the second opening, the first and second sections being connected at an elbow, wherein the longitudinal axis of the first section is angled with respect to the longitudinal axis of the second section;

the first section of the channel having a first cross-sectional area and the second section of the channel having a second cross-sectional area, wherein the second cross-sectional area is greater than the first cross sectional area.

2. The flow control nozzle of claim 1, wherein the first section of the channel has a constant cross-sectional area.

3. The flow control nozzle of claim 1, wherein the first section of the channel has a longitudinal axis that is parallel with a longitudinal axis of the body or is at an angle relative to the longitudinal axis of the body.

4. The flow control nozzle of claim 3, wherein the first section of the channel is provided at an angle of between about 0° and about 25° with respect to the longitudinal axis of the body.

5. The flow control nozzle of claim 1, wherein second section of the channel has a cross-sectional area that increases in a direction from the elbow to the second opening.

6. The flow control nozzle of claim 5, wherein the second section of the channel has a conical profile.

7. The flow control nozzle of claim 6, wherein the second opening is elliptical.

8. The flow control nozzle of claim 1, wherein second section of the channel has a constant cross-sectional area along its length.

9. The flow control nozzle of claim 1, wherein the second section of the channel has a longitudinal axis that is angled with respect to a longitudinal axis of the body.

10. The flow control nozzle of claim 9, wherein the longitudinal axis is provided at an angle between about 3° and about 12° with respect to the longitudinal axis of the body.

11. The flow control nozzle of claim 9, wherein the longitudinal axis is provided at an angle between about 8° and about 10° with respect to the longitudinal axis of the body.

12. The flow control nozzle of claim 1, wherein the second surface includes an extension portion adapted to be received within the aperture on the pipe and wherein the second opening is provided in the extension portion.

13. The flow control nozzle of claim 1, wherein the second surface is adapted to be received within a recess provided on the outer surface of the pipe.

14. An apparatus for controlling flow of fluids to or from a subterranean reservoir, the apparatus comprising:

a base pipe for communicating the fluids to or from the reservoir, the base pipe having at least one aperture extending through the wall thereof;

a screen for filtering the fluids, the screen provided on the outer surface of the base pipe, the screen having at least one opening proximal to the aperture;

at least one collar provided over the base pipe and adapted to secure the screen to the base pipe; and, a nozzle comprising:

a body having first and second surfaces, first and second sides, and front and rear ends;

the body having a channel for conducting the fluid there-through, wherein the channel provides fluid communication between a first opening provided on the front end and a second opening provided on the second surface the second opening being adapted to be in fluid communication with the aperture on the base pipe;

the channel having a first section extending from the first opening and a second section extending to the second opening, the first and second sections being connected at an elbow, wherein the longitudinal axis of the first section is angled with respect to the longitudinal axis of the second section;

the first section of the channel having a first cross-sectional area and the second section of the channel having a second cross-sectional area, wherein the second cross-sectional area is greater than the first cross sectional area;

the nozzle being positioned between the at least one opening of the screen and the aperture on the base pipe and wherein the nozzle is positioned beneath the collar.

15. The apparatus of claim 14, wherein the first section of the channel has a constant cross-sectional area.

16. The apparatus of claim 14, wherein the first section of the channel has a longitudinal axis that is parallel with a longitudinal axis of the body or is at an angle relative to the longitudinal axis of the body.

17. The apparatus of claim 16, wherein the first section of the channel is provided at an angle of between about 0° and about 25° with respect to the longitudinal axis of the body.

18. The apparatus of claim 14, wherein second section of the channel has a cross-sectional area that increases in a direction from the elbow to the second opening.

19. The apparatus of claim 18, wherein the second section of the channel has a conical profile.

20. The apparatus of claim 19, wherein the second opening is elliptical.

21. The apparatus of claim 14, wherein second section of the channel has a constant cross-sectional area along its length.

22. The apparatus of claim 14, wherein the second section of the channel has a longitudinal axis that is angled with respect to a longitudinal axis of the body.

23. The apparatus of claim 22, wherein the longitudinal axis is provided at an angle between about 3° and about 12° with respect to the longitudinal axis of the body.

24. The apparatus of claim 22, wherein the longitudinal axis is provided at an angle between about 8° and about 10° with respect to the longitudinal axis of the body.

25. The apparatus of claim 14, wherein the second surface includes an extension portion adapted to be received within the aperture on the base pipe and wherein the second opening is provided in the extension portion.

26. The apparatus of claim 14, wherein the second surface is adapted to be received within a recess provided on the outer surface of the base pipe and surrounding the aperture.

* * * * *